US012247777B2

(12) United States Patent
Lyu et al.

(10) Patent No.: US 12,247,777 B2
(45) Date of Patent: Mar. 11, 2025

(54) REFRIGERATOR AND GLASS DOOR THEREOF

(71) Applicants: QINGDAO HAIER REFRIGERATOR CO., LTD., Shandong (CN); HAIER SMART HOME CO., LTD., Shandong (CN)

(72) Inventors: Peng Lyu, Qingdao (CN); Hao Zhang, Qingdao (CN); Jiaming Li, Qingdao (CN); Zhanpeng Cui, Qingdao (CN); Sen Mou, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 57 days.

(21) Appl. No.: 18/245,207

(22) PCT Filed: Sep. 7, 2021

(86) PCT No.: PCT/CN2021/116937
§ 371 (c)(1),
(2) Date: Mar. 14, 2023

(87) PCT Pub. No.: WO2022/057685
PCT Pub. Date: Mar. 24, 2022

(65) Prior Publication Data

US 2023/0408172 A1 Dec. 21, 2023

(30) Foreign Application Priority Data

Sep. 15, 2020 (CN) ..... 202010969249.9

(51) Int. Cl.
*F25D 23/02* (2006.01)
*F25D 21/04* (2006.01)
*F25D 17/06* (2006.01)

(52) U.S. Cl.
CPC ..... *F25D 23/028* (2013.01); *F25D 21/04* (2013.01); *F25D 17/065* (2013.01); *F25D 2317/062* (2013.01); *F25D 2323/023* (2013.01)

(58) Field of Classification Search
CPC .. F25D 23/028; F25D 23/02; F25D 2323/023; F25D 2400/18; F25D 21/04;
(Continued)

(56) References Cited

U.S. PATENT DOCUMENTS 2,724,242 A * 11/1955 Pulaski ..... F25D 17/04 62/283
5,228,240 A * 7/1993 Barroero ..... F25D 23/087 49/478.1
(Continued)

FOREIGN PATENT DOCUMENTS

CN 1257640 A 6/2000
CN 2554571 Y 6/2003
(Continued)

OTHER PUBLICATIONS

1st Examination Report for Australian Patent Application No. 2021342448 dated Feb. 2, 2024 (3 pages).
(Continued)

*Primary Examiner* — Hiwot E Tefera
(74) *Attorney, Agent, or Firm* — ALSTON & BIRD LLP

(57) ABSTRACT

A refrigerator and a glass door thereof. The glass door of the refrigerator comprises a glass plate body and an outer frame; the outer frame is configured to be hinged to a refrigerator body or a door body of the refrigerator; the outer frame extends along the edge of the glass plate body and is fixedly connected to the edge of the glass plate body; and the outer frame covers part of the edge of the glass plate body. The glass door has a lighter weight and a better appearance, and
(Continued)

causes the overall thickness of the refrigerator having a composite door structure to be reduced.

7 Claims, 7 Drawing Sheets

(58) Field of Classification Search
CPC .. F25D 2323/02; F25D 23/025; F25D 17/065; F25D 2317/062; F25D 2317/061; F25D 2317/067; F25D 2317/0664; F25D 2317/0672; F25D 2317/065; F25D 2317/0651; F25D 2317/063
See application file for complete search history.

(56) References Cited

U.S. PATENT DOCUMENTS

| | | | | |
|---|---|---|---|---|
| 5,852,284 | A * | 12/1998 | Teder | H05B 3/84 219/219 |
| 5,996,370 | A * | 12/1999 | Lee | F25D 17/062 62/DIG. 13 |
| 2008/0223061 | A1* | 9/2008 | Hixson | A47F 3/0426 62/82 |
| 2009/0072679 | A1 | 3/2009 | Avila et al. | |
| 2015/0107291 | A1* | 4/2015 | Mitchell | F25D 17/065 62/340 |
| 2015/0330678 | A1* | 11/2015 | Hu | F25C 5/22 62/3.6 |
| 2018/0112906 | A1* | 4/2018 | Yi | F25D 21/04 |
| 2018/0112909 | A1* | 4/2018 | Choi | F25D 23/02 |
| 2019/0059613 | A1* | 2/2019 | Artwohl | E06B 3/6612 |
| 2020/0248950 | A1* | 8/2020 | Schork | F25D 17/065 |
| 2020/0326120 | A1* | 10/2020 | Kim | F25D 23/028 |
| 2022/0221216 | A1* | 7/2022 | Jin | F25D 21/04 |
| 2022/0408941 | A1* | 12/2022 | Hwang | F25D 21/04 |

FOREIGN PATENT DOCUMENTS

| | | | |
|---|---|---|---|
| CN | 201731719 | U | 2/2011 |
| CN | 108072224 | A | 5/2018 |
| CN | 209197275 | U | 8/2019 |
| KR | 2000-0053871 | A | 9/2000 |
| KR | 101349159 | B1 | 1/2014 |
| KR | 20160044721 | A | 4/2016 |

OTHER PUBLICATIONS

1$^{ST}$ Office Action for European Patent Application No. 21868510.5 dated Feb. 2, 2024 (5 pages).
Supplementary European Search Report for European Patent Application No. 2186510.5 dated Jan. 22, 2024 (3 pages).
International Search Report and Written Opinion for PCT/CN2021/116937 (ISA/CN) mailed Dec. 8, 2021 w/English translation (9 pages).
1st Office Action for China Patent Application No. 202010969249,9 dated Nov. 28, 2024, with English translation (16 pages).

* cited by examiner

REFRIGERATOR AND GLASS DOOR THEREOF

CROSS-REFERENCE TO RELATED APPLICATIONS

The present application is a national phase entry of International Application No. PCT/CN2021/116937, filed Sep. 7, 2021, which claims priority to Chinese Application No. 202010969249.9, filed Sep. 15, 2020, which are each incorporated herein by reference in its entirety.

FIELD OF THE INVENTION

The present invention relates to the technical field of refrigeration and freezing, and in particular to a refrigerator and a glass door thereof.

BACKGROUND OF THE INVENTION

A traditional refrigerator door body generally includes a door housing at an outer side, and a door liner at an inner side, generally a thick foamed layer is further arranged between the door housing and the door liner, and the door liner is further provided with a shelving device such as a bottle holder. Such door body is quite thick and heavy, which is difficult to open and close by a user.

With development of technologies, some composite door structures have emerged in the field of refrigerators. A chamber for storage is formed inside a door body of a refrigerator, and a secondary door is additionally arranged at a front side of the door body to open or close the chamber of the door body. For a refrigerator adopting such composite door technology, double door body layers are arranged and more articles are stored on the door body. Therefore, the door body is thicker and heavier, causing that a user has undesirable experience in opening and closing the door body, and an excessive large thickness of the door body also seriously affects the appearance aesthetics of the refrigerator.

BRIEF DESCRIPTION OF THE INVENTION

A purpose of the present invention is to at least overcome one of the above shortcomings existing in the prior art, and to provide a more portable and more beautiful glass door applied to a refrigerator.

Another purpose of the present invention is to provide a refrigerator using the glass door.

A further purpose of the present invention is to make a refrigerator with a composite door structure have a smaller overall thickness.

In one aspect, the present invention provides a glass door applied to a refrigerator, including:

a glass plate body; and an outer frame, configured to be hinged to a refrigerator body or a door body of the refrigerator, where the outer frame extends along an edge of the glass plate body and is fixedly connected to the edge of the glass plate body; and the outer frame covers part of the edge of the glass plate body.

Optionally, the outer frame includes a vertical frame and two transverse frames that are bent and extend from two ends of the vertical frame in a length direction, so as to cover a vertical side of the glass plate body and some sections of two transverse sides connected to the vertical side.

Optionally, a section, that is not covered by the transverse frame, of one transverse side of the glass plate body includes a handle portion protruding along a vertical direction.

Optionally, a ratio of a length of each transverse frame to a length of the transverse side of the glass door body is 2/5 to 3/5.

Optionally, the outer frame is provided with a clamping slot with an opening toward the edge of the glass plate body to fixedly clamp the edge of the glass plate body.

Optionally, the glass plate body is made of vacuum glass.

In another aspect, the present invention further provides a refrigerator, including the glass door according to any one of the above descriptions.

Optionally, the refrigerator includes a refrigerator body, with a front side opened to define a first chamber; and a door body, installed on the refrigerator body to open and close the first chamber, where the door body defines a second chamber with an opened front side; and the glass door is installed on the door body to open and close the second chamber.

Optionally, a rear wall of the door body is provided with an air supply port and an air return port that are both in communication with the first chamber and the second chamber. The rear wall is in a hollow shape, inside which a dew removal air duct in communication with the first chamber is defined. A front surface of the rear wall is backwards provided with a plurality of dew removal holes in communication with the second chamber and the dew removal air duct. The refrigerator is configured to be: in a cooling cycle mode in which air in the first chamber enters the second chamber via the air supply port and then returns to the first chamber via the air return port; or in a dew removal mode in which the air in the first chamber enters the dew removal air duct, so that part of an air flow flows to the front surface of the rear wall via the dew removal holes to remove dew formed on the front surface.

Optionally, in a direction from the air supply port to the air return port, an arrangement density of the dew removal holes is gradually reduced.

The glass door applied to a refrigerator in the present invention includes a glass plate body and an outer frame that are fixedly connected, and the outer frame is hinged to other members (for example, a refrigerator body or a door body) of the refrigerator. In comparison with a traditional door body, the glass door is thinner, and more beautiful in appearance. In addition, according to the present invention, the outer frame is not a complete square frame, but is of a half-frame structure that covers only part of the edge of the glass plate body. On the premise of guaranteeing a connection strength, the outer frame is enabled to be smaller in total length, lighter in weight, cheaper in cost, and more unique in appearance. In addition, according to the present invention, the glass plate body is made of vacuum glass, so that the glass plate body has a better heat insulation property.

Further, the glass door provided by the present invention is especially applicable to a composite door type refrigerator, of which a door body is provided with a second chamber, and the second chamber is opened and closed through the glass door. The glass door is lighter and thinner, and therefore the second chamber is easier to open and close. In addition, such structure enables the overall door body (including the door body and the glass door) of the composite door type refrigerator to be not too thick or too heavy. In this way, the overall door body is easier to open and close. Moreover, the outer frame of the glass door used is of a half-frame structure, so that a user can have a wider view and can observe more details inside the second chamber, and thus the product grade is increased.

Further, according to the present invention, the door body is specially designed to effectively remove dew on an inner wall of the second chamber. Specifically, according to the present invention, the rear wall of the door body is specially designed in a hollow shape to define a dew removal air duct, and the front surface of the rear wall is backwards provided with a plurality of dew removal holes. When normal refrigeration is required in the second chamber, the refrigerator runs in a cooling cycle mode, so that air in the first chamber normally enters the second chamber via the air supply port so as to implement refrigeration in the second chamber. When dew generated on a rear wall surface of the second chamber (namely the front surface of the rear wall of the door body) is to be removed, the refrigerator runs in a dew removal mode, so that air in the first chamber enters the dew removal air duct inside the rear wall of the door body, and thus part of the air flow flows to the front surface of the rear wall via the dew removal holes. The air in the dew removal air duct must have a lower relative humidity than the original air flow at the front surface of the rear wall of the door body (the air close to dew must have a quite high relative humidity). Therefore, introduction of low-humidity air in the dew removal air duct can promote evaporation of the dew.

In addition, when the refrigerator provided by the present invention runs in the dew removal mode, a traditional way of electrically heating the rear wall or introducing hot air is not adopted. Instead, cold air in the first chamber is used to remove dew, and a dew removal process has no influences on normal refrigeration of the second chamber, realizing a quite ingenious structural design.

Specific embodiments of the present invention are described below in detail with reference to the accompanying drawings, and persons skilled in the art can more clearly understand the above and other purposes, advantages and features of the present invention.

BRIEF DESCRIPTION OF THE DRAWINGS

Some specific embodiments of the present invention are described below in detail in an exemplary and unlimited way with reference to the accompanying drawings. The same or similar components or parts are indicated by the same reference numerals in the drawings. Persons skilled in the art should understand that these drawings are not necessarily drawn to scale. In the drawings.

DETAILED DESCRIPTION

A refrigerator and a glass door thereof according to embodiments of the present invention are described with reference to FIG. 1 to FIG. 7. The orientations or positional relationships indicated by "front", "rear", "up", "down", "top", "bottom", "inside", "outside", "transverse" and the like are based on the orientations or positional relationships shown in the accompanying drawings. Such terms are intended merely for the ease and brevity of description of the present invention without indicating or implying that the apparatuses or components mentioned must have specified orientations or must be constructed and manipulated in the specified orientations, and therefore shall not be construed as any limitation on the present invention.

An embodiment of the present invention provides a glass door applied to a refrigerator. The glass door is installed on a refrigerator body or a door body of the refrigerator to open and close a corresponding storage chamber.

Figure 1:
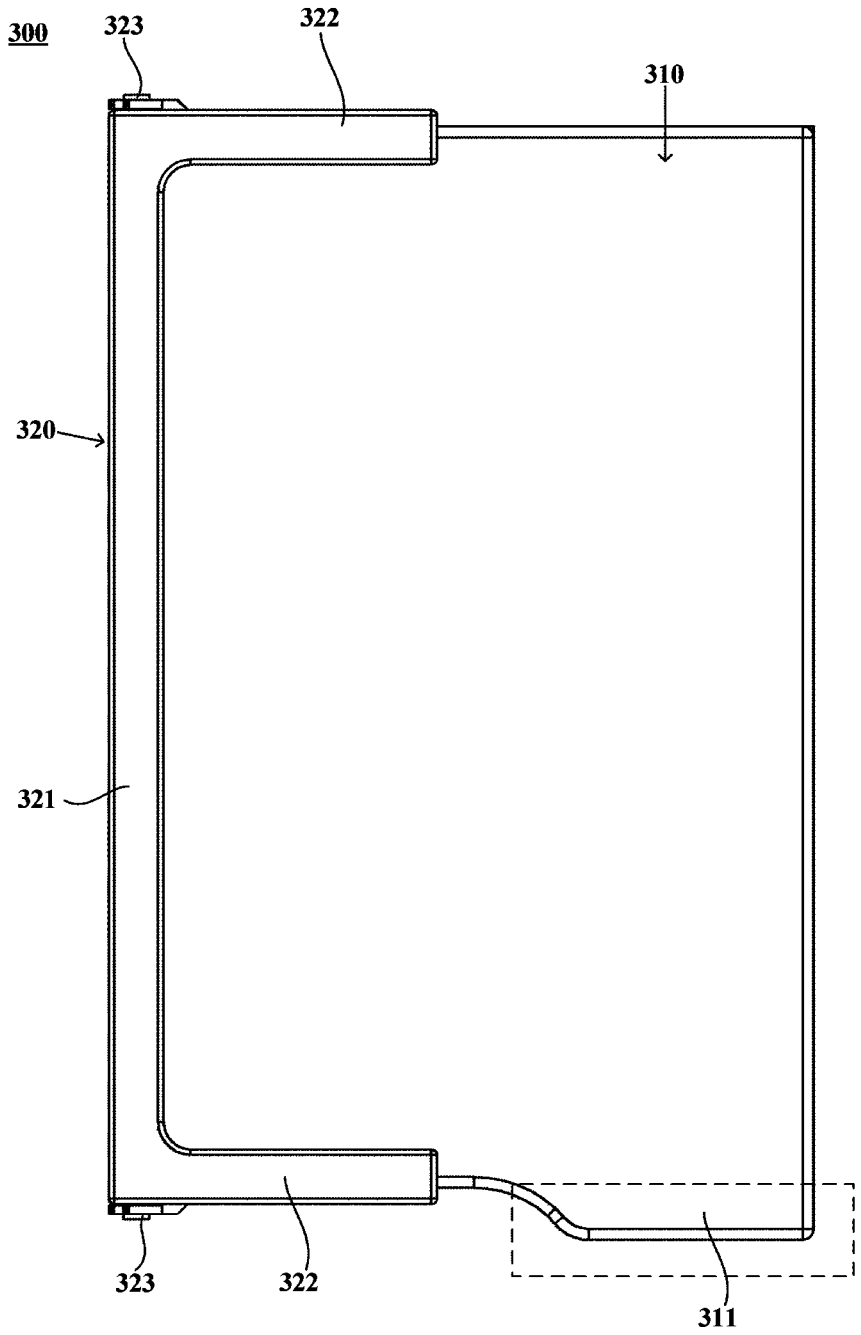
FIG. 1 is a schematic structural diagram of a glass door applied to a refrigerator according to an embodiment of the present invention.
Figure 2:
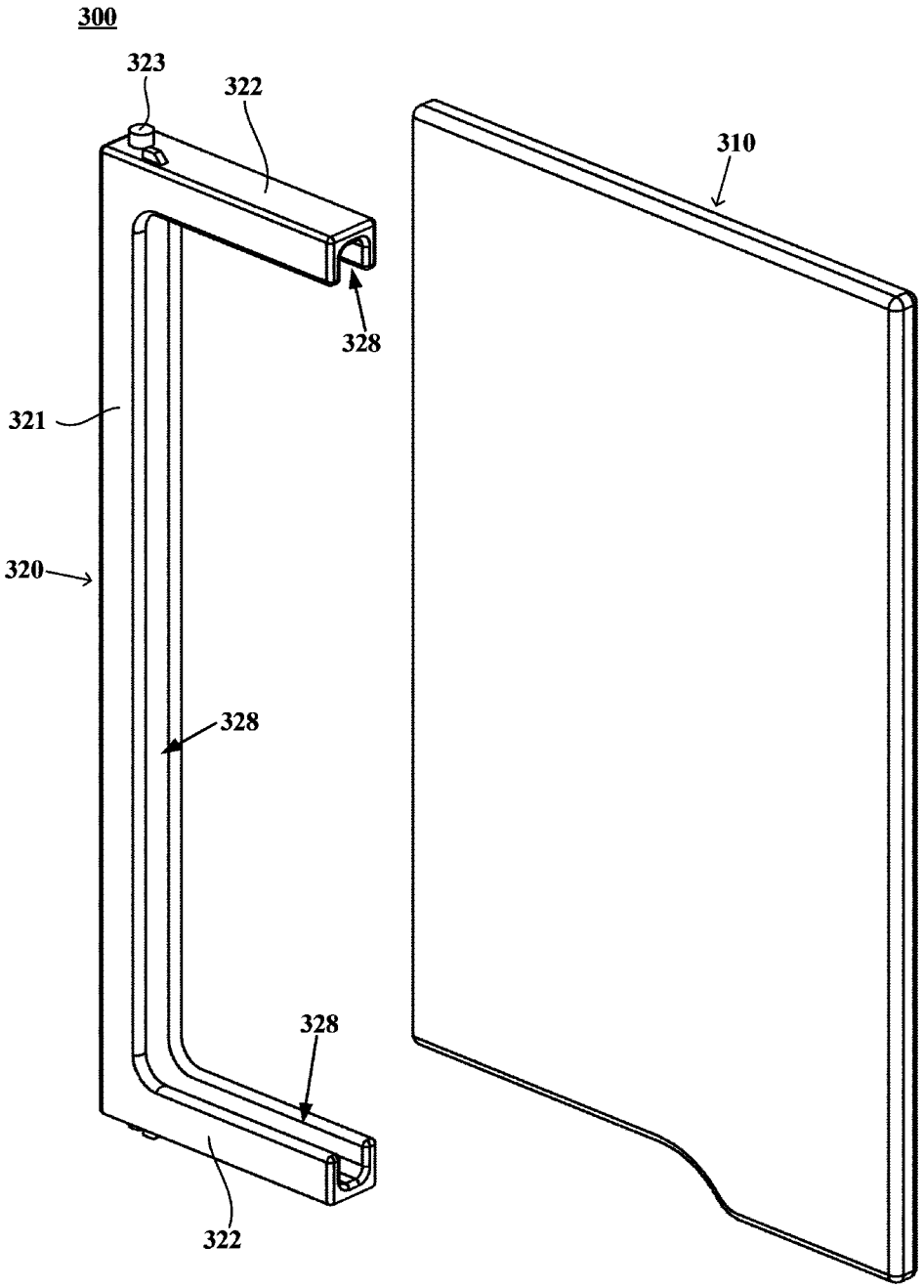
FIG. 2 is a schematic exploded view of the glass door shown in FIG. 1.

FIG. 1 is a schematic structural diagram of a glass door applied to a refrigerator according to an embodiment of the present invention, and FIG. 2 is a schematic exploded view of the glass door shown in FIG. 1. As shown in FIG. 1 and FIG. 2, the glass door 300 applied to a refrigerator according to this embodiment of the present invention may generally include a glass plate body 310 and an outer frame 320. The glass plate body 310 is shaped as a flat plate and constitutes a main body part of the glass door 300. The glass plate body 310 may be made of vacuum glass so as to improve a heat insulation property thereof.

The outer frame 320 is configured to be hinged to a refrigerator body or a door body of the refrigerator. As shown in FIG. 1, upper and lower ends of the outer frame 320 are each provided with a hinge shaft 323 to realize being hinged to the refrigerator body or the door body. The outer frame 320 extends along an edge of the glass plate body 310 and is fixedly connected to the edge of the glass plate body 310. In other words, the outer frame 320 covers only part of the edge of the glass plate body 310, so that a main part of the glass plate body 310 is not shielded, thus making good use of its advantage of transparency. The outer frame 320 covers part of the edge of the glass plate body 310. That is, the remaining edge of the glass plate body 310 is exposed outside.

In this embodiment of the present invention, in comparison with a traditional door body, the glass door 300 is thinner, and more beautiful in appearance. In addition, according to this embodiment of the present invention, the outer frame 320 is not a complete square frame, but is of a half-frame structure that covers only part of the edge of the glass plate body 310. On the premise of guaranteeing a connection strength, the outer frame 320 is enabled to be smaller in total length, lighter in weight, cheaper in cost, and more unique in appearance. The existing glass door bodies of some furniture or other products are generally a totally-sealed outer frame structure, so that all edges of glass are covered, which lacks novelty. However, this embodiment of the present invention breaks through the constraint of such a design habit and creates a totally new glass door design concept.

In some embodiments, as shown in FIG. 1 and FIG. 2, the outer frame 320 includes a vertical frame 321 and two transverse frames 322 that are bent and extend from two ends of the vertical frame 321 in a length direction (the overall outer frame 320 is in a "U" shape with an opening toward an open side of the glass door 300), so as to cover a vertical side of the glass plate body 310 and some sections of two transverse sides connected to the vertical side. Such shape of the outer frame 320 facilitates arrangement of a hinging structure, and also meets a strength requirement of the outer frame 320. With such shape, the outer frame 320 has the simplest structure and the lightest weight, thus more material costs are reduced.

Further, a ratio of a length of each transverse frame 322 to a length of the transverse side of the glass door 300 body may be ⅖ to ⅗, so as to realize optimal combination of strength and portability.

In some embodiments, as shown in FIG. 1 and FIG. 2, the outer frame 320 may be provided with a clamping slot 328 with an opening toward the edge of the glass plate body 310 to fixedly clamp the edge of the glass plate body 310, thereby realizing fixed connection of the outer frame 320 and the glass plate body 310. Such fixation manner realizes a simple structure and a quite firm connection. Certainly, in some alternative embodiments, the two may be connected in other manners, for example, in an adhesion manner.

In some embodiments, as shown in FIG. 1 and FIG. 2, a section, that is not covered by the transverse frame 322, of one transverse side of the glass plate body 310 may include a handle portion 311 protruding along a vertical direction. For example, the handle portion 311 (a position indicated by a dotted box in FIG. 1 is the handle portion 311) protruding downwards is formed in a right section of a lower edge of the glass plate body 310. In this embodiment, the handle portion 311 is formed based on the shape of the glass plate body 310 without additionally arranging a handle made of plastic or another material on the surface of the glass, thus the glass plate body 310 has a simpler overall structure.

An embodiment of the present invention further provides a refrigerator, including the glass door 300 according to any one of the above embodiments. A structure of the refrigerator is not additionally limited in this embodiment of the present invention. The refrigerator can perform refrigeration through a vapor compression refrigeration circulation system, a semiconductor refrigeration system, or other ways. According to differences of refrigeration temperatures, chambers inside the refrigerator may be divided into a refrigeration chamber, a freezing chamber and a variable-temperature chamber. For example, a temperature in the refrigeration chamber is generally controlled between 2° C. and 10° C., preferably between 4° C. and 7° C. A temperature in the freezing chamber is generally controlled between −22° C. and −14° C. A temperature in the variable-temperature chamber may be adjusted between −18° C. and 8° C. so as to realize a temperature variation effect. Different types of objects should be stored at different optimal storage temperatures, and also should be stored in different storage chambers. For example, fruit and vegetable foods are suitable for being stored in a refrigeration chamber, while meat foods are suitable for being stored in a freezing chamber.

Figure 3:
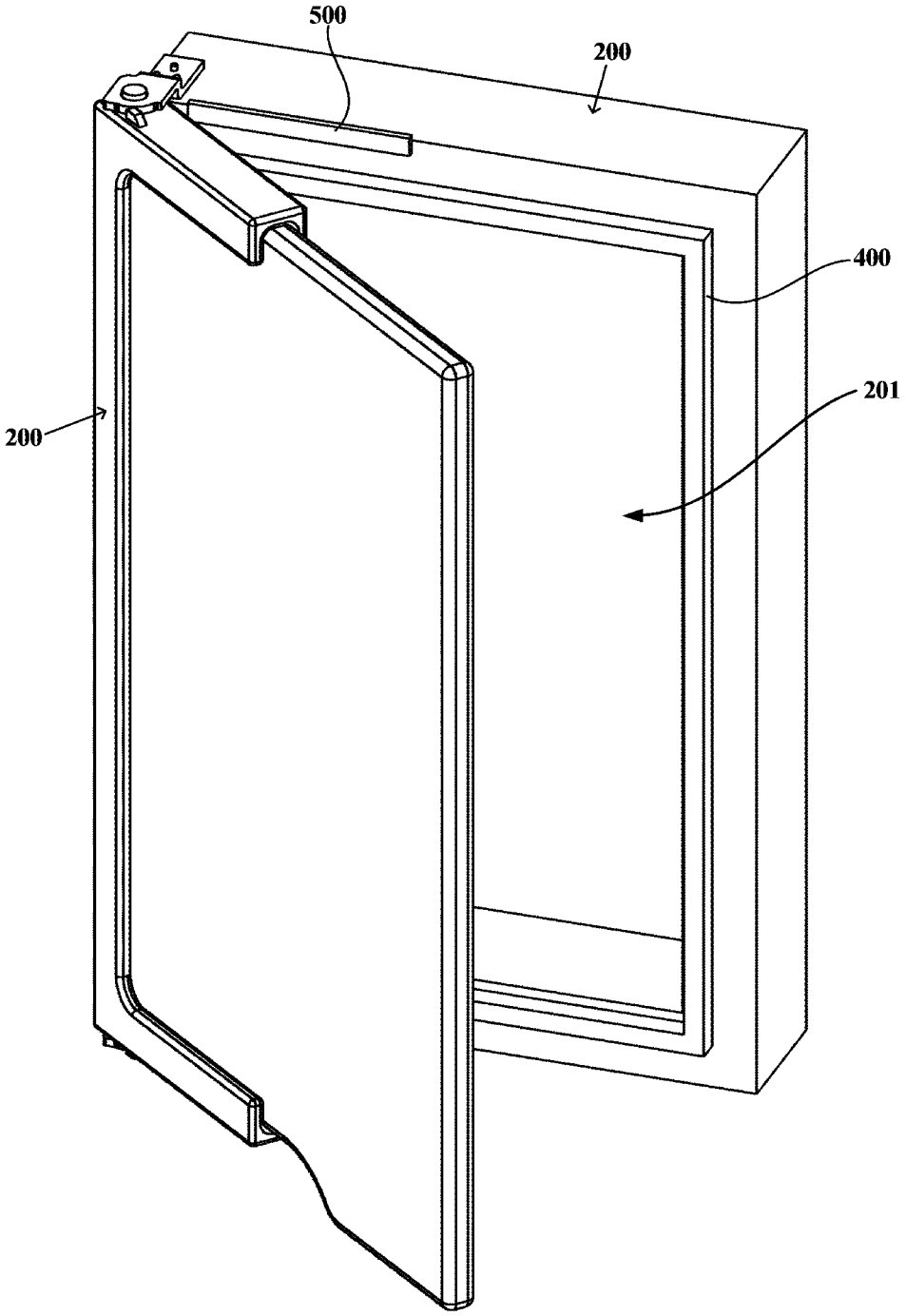
FIG. 3 is a schematic diagram of an assembling structure for a door body and a glass door in a refrigerator according to an embodiment of the present invention.

The glass door 300 provided by the present invention is especially applicable to a composite door type refrigerator. FIG. 3 is a schematic diagram of an assembling structure for a door body and a glass door 300 in a refrigerator according to an embodiment of the present invention, and FIG. 4 is a schematic diagram of a refrigerator in a cooling cycle mode according to an embodiment of the present invention.

Figure 4:
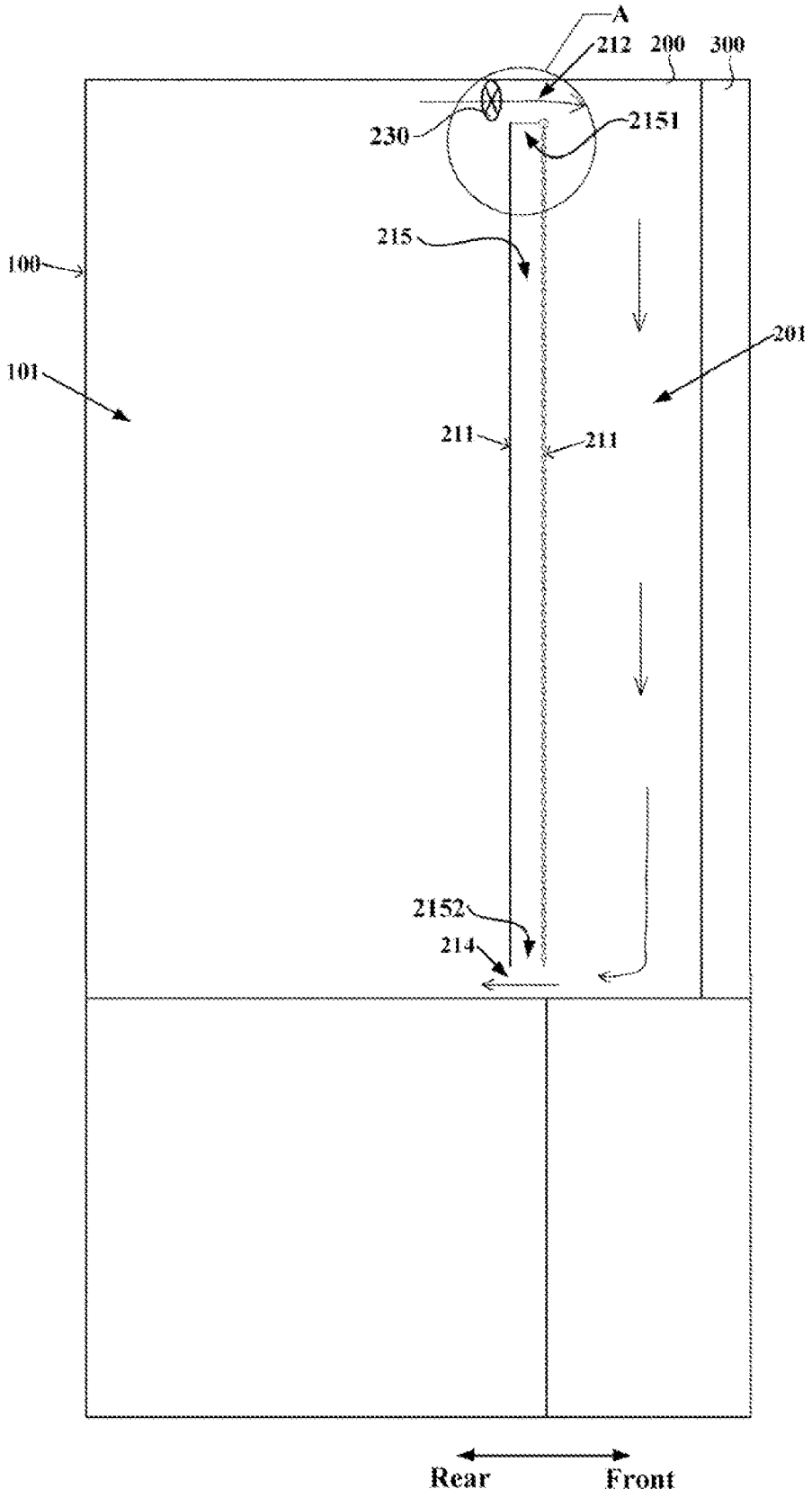
FIG. 4 is a schematic diagram of a refrigerator in a cooling cycle mode according to an embodiment of the present invention.

As shown in FIG. 3 and FIG. 4, the refrigerator is a composite door refrigeration, and specifically the refrigerator includes a refrigerator body 100, a door body 200 and a glass door 300. A front side of the refrigerator body 100 is opened to define a first chamber 101. The door body 200 is installed on the refrigerator body 100 to open and close the first chamber 101, and the door body 200 defines a second chamber 201 with an opened front side. The glass door 300 is installed on the door body 200 to open and close the second chamber 201. The first chamber 101 of this embodiment of the present invention is preferably a refrigeration chamber. The front side of the door body 200 may be provided with a sealing strip 400 to seal between the door body and a rear surface of the glass door 300. The front side of the door body 200 may be further provided with a magnet 500 for attracting another magnet on the glass door 300, so that the glass door 300 is closed more tightly, and thus leakage of cold air is reduced.

The door body 200 may be rotatably installed on the refrigerator body 100 at the front side of the refrigerator body 100; the front side of the door body 200 is opened to define the second chamber 201, and the glass door 300 is rotatably installed on the door body 200 at the front side of the door body 200. When the door body 200 is opened, a user stores or gets objects in the first chamber 101. When the door body 200 is closed and the glass door 300 is opened, a user can store or get objects in the second chamber 201.

According to this embodiment of the present invention, the second chamber 201 is opened and closed through the glass door 300. The glass door 300 is lighter and thinner, and therefore the second chamber 201 is easier to open and close by a user. In addition, the overall door body (including the door body 200 and the glass door 300) of the composite door type refrigerator is not too thick or too heavy, making it easier to open and close the overall door body. Moreover, the outer frame 320 of the glass door 300 used is of a half-frame structure, so that a user can have a wider view and can observe more details inside the second chamber 201, and thus the product grade is increased.

Figure 5:
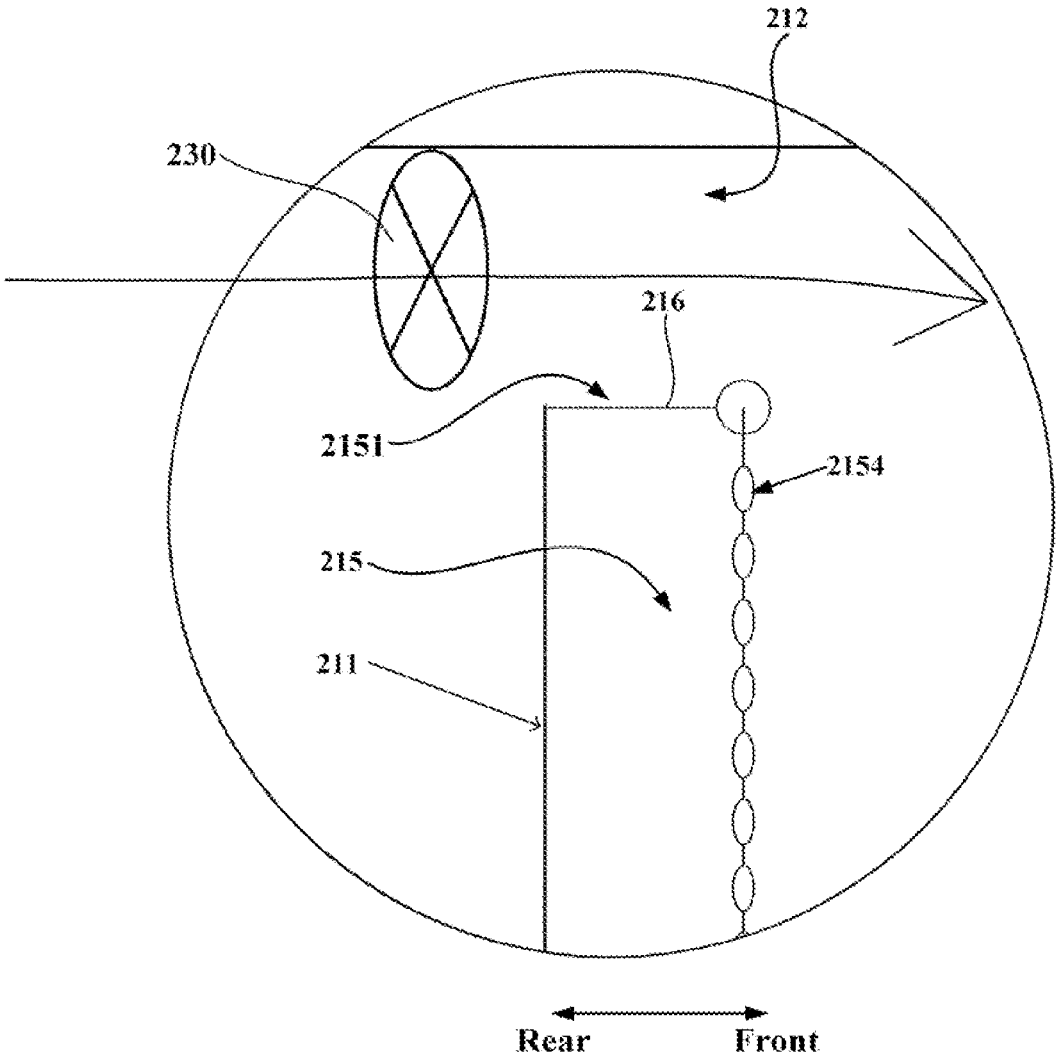
FIG. 5 is an enlarged view of a location A in FIG. 4.
Figure 6:
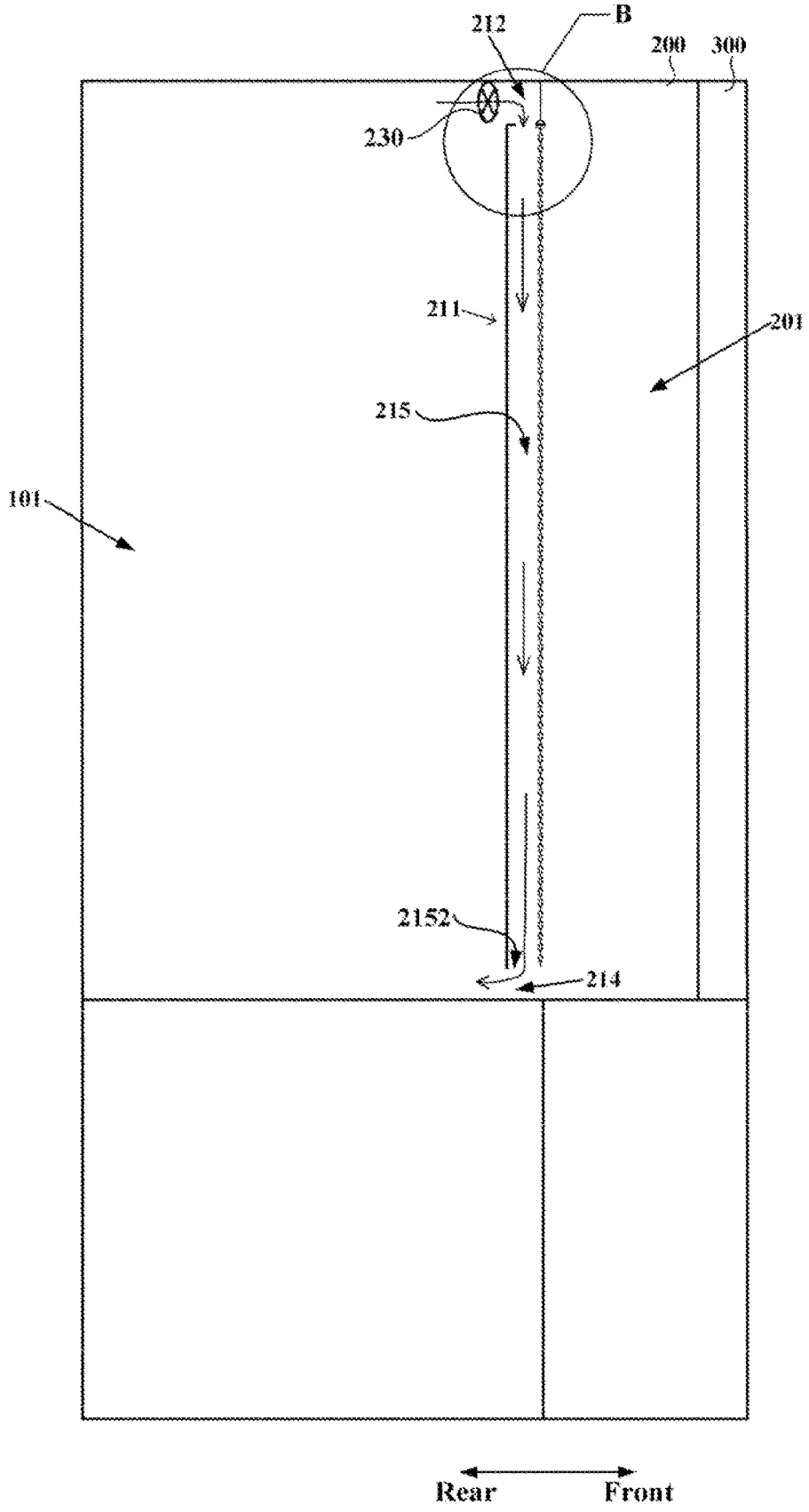
FIG. 6 is a schematic diagram of a state of the refrigerator shown in FIG. 4 in a dew removal mode.
Figure 7:
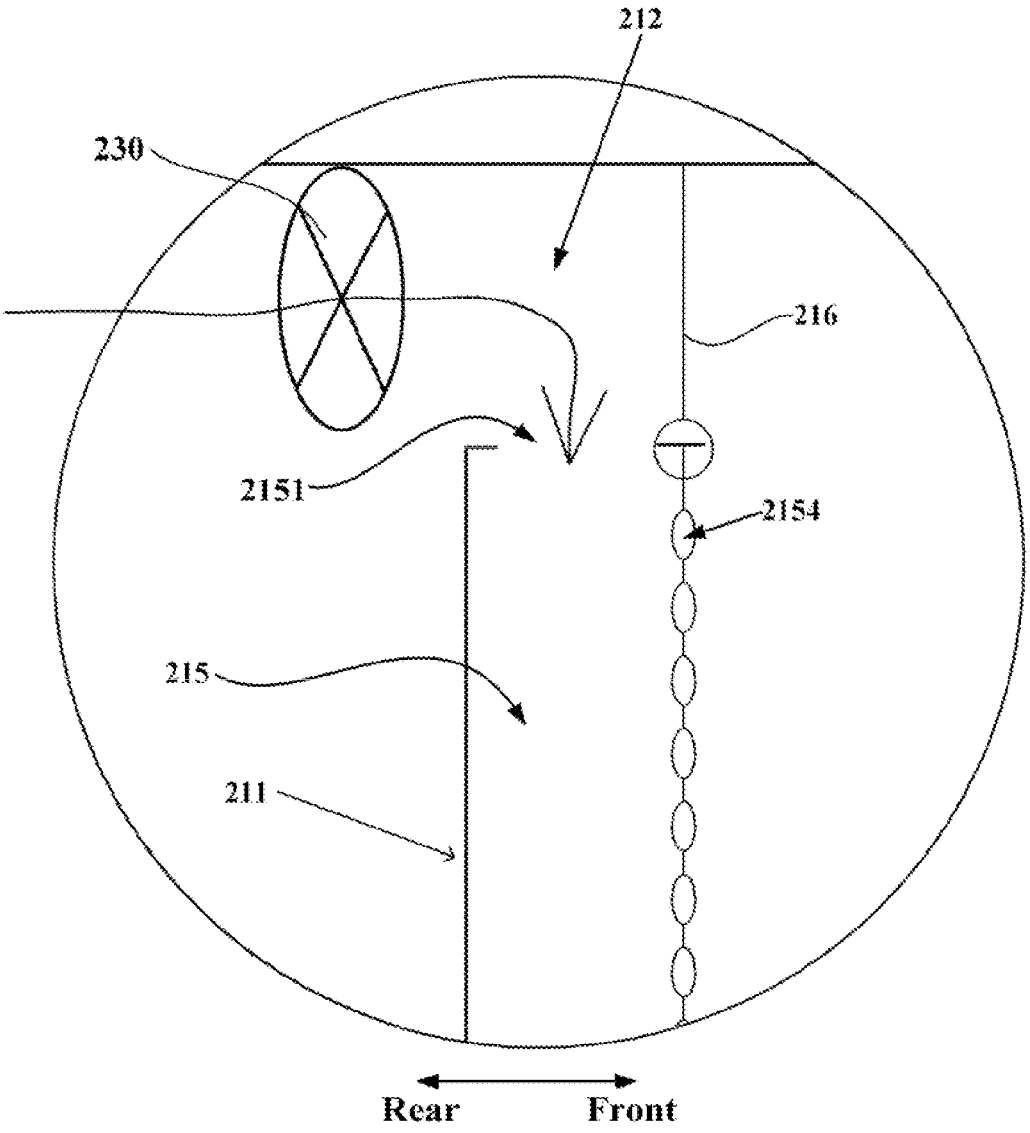
FIG. 7 is an enlarged view of a location B in FIG. 6.

FIG. 5 is an enlarged view of a location A in FIG. 4; FIG. 6 is a schematic diagram of a state of the refrigerator shown in FIG. 4 in a dew removal mode; FIG. 7 is an enlarged view of a location B in FIG. 6; and an air direction is indicated by an arrow in each figure.

In an existing composite door type refrigerator, the problem of condensation on the inner wall of the chamber (the second chamber 201 in the present invention) of the door body often occurs. The inventors have realized that the rear wall 211 of the door body 200 is close to the first chamber 101, and can transfer heat with the air in the first chamber 101 via heat conduction. Therefore. the temperature at the front surface of the rear wall 211 is lower than the temperature at the other wall surfaces of the second chamber 201, and it is easier to generate dew.

On the basis of the above concept, in this embodiment of the present invention, the door body 200 is specially designed, and dew removal is specially performed for the front surface of the rear wall 211 of the second chamber 201. Specifically, the rear wall 211 of the door body 200 is provided with an air supply port 212 and an air return port 214 that are both in communication with the first chamber 101 and the second chamber 201. In addition, the rear wall 211 of the door body 200 is in a hollow shape, inside which a dew removal air duct 215 in communication with the first chamber 101 is defined. That is, a hollow space of the rear wall 211 forms the dew removal air duct 215. The front surface of the rear wall 211 is backwards provided with a plurality of dew removal holes 2154 in communication with the second chamber 201 and the dew removal air duct 215. The refrigerator is configured to be: in a cooling cycle mode in which the air in the first chamber 101 enters the second chamber 201 via the air supply port 212 and then returns to the first chamber 101 via the air return port 214, so as to refrigerate the second chamber 201 with the cold air in the first chamber 101, as shown in FIG. 4 and FIG. 5. Alternatively, the refrigerator runs in a dew removal mode in which the air in the first chamber 101 enters the dew removal air duct 215, so that part of an air flow flows to the front surface of the rear wall 211 via the dew removal holes 2154 to remove dew formed on the front surface of the rear wall, as shown in FIG. 6 and FIG. 7.

In this embodiment of the present invention, the refrigerator is usually in the aforementioned cooling cycle mode. However, when a lot of dew appears on the front surface of the rear wall 211 of the door body 200 due to introduction of wet air as the door is opened and closed or storage of a high-humidity object, the refrigerator may be controlled to run in the aforementioned dew removal mode, so that the air in the first chamber 101 enters the dew removal air duct 215 inside the rear wall 211 of the door body 200, and thus part of the air flow flows to the front surface of the rear wall 211 via the dew removal holes 2154. The air in the dew removal air duct 215 must have a lower relative humidity than the original air flow at the front surface of the rear wall 211 of the door body 200 (the air close to the dew must have a quite high relative humidity). Therefore, introduction of low-humidity air in the dew removal air duct 215 can promote evaporation of the dew to complete a dew removal process. After dew is removed, the refrigerator can be controlled to switch to the cooling cycle mode.

The timing for switching the cooling cycle mode to the dew removal mode may be automatically controlled by the refrigerator, for example, a running mode of the refrigerator is periodically switched or automatically switched according to a detection result of a humidity sensor. Alternatively, the running mode of the refrigerator may be manually controlled, for example, the running mode of the refrigerator may be manually controlled when a user needs to remove dew or needs to stop removing dew.

When the refrigerator provided by this embodiment of the present invention runs in the dew removal mode, a traditional way of electrically heating the rear wall 211 or introducing hot air is not adopted. Instead, cold air in the first chamber 101 is used to remove dew, and a dew removal process has no influences on normal refrigeration of the second chamber 201, realizing a quite ingenious structural design.

In some embodiments, as shown in FIG. 4 and FIG. 6, the dew removal air duct 215 may include an inlet 2151 and an outlet 2152 that are in communication with the first chamber 101, so that an air path circulation is formed between the dew removal air duct 215 and the first chamber 101. Thus, the air flow for removing dew is prevented from being accumulated in the dew removal air duct 215 and near the dew removal holes 2154, so as not to affect a dew removal effect. In addition, the refrigerator is further configured to make the inlet 2151 and the outlet 2152 in a closed state and an open state respectively when in the cooling cycle mode; and make the inlet 2151 and the outlet 2152 both in an open state when in the dew removal mode. In other words, when the refrigerator runs in the cooling cycle mode, only the inlet 2151 of the dew removal air duct 215 needs to be closed. When the refrigerator runs in the dew removal mode, the inlet 2151 of the dew removal air duct 215 is opened. Since the opening and closing of the dew removal air duct 215 have been controlled by opening and closing the inlet 2151 and the outlet 2152 thereof, the outlet 2152 of the dew removal air duct 215 needs not to be controlled. Under the two modes, the outlet 2152 of the dew removal air duct 215 is in a normally open state and needs not to be controlled, so as to simplify the structure and control of the refrigerator.

In some embodiments, as shown in FIG. 4 and FIG. 6, the inlet 2151 of the dew removal air duct 215 may be in communication with the air supply port 212 by penetrating through a sidewall of the air supply port 212. That is, the dew removal air duct 215 is in communication with the first chamber 101 via the air supply port 212, and there is no need to form another opening in the rear wall 211. Also, the outlet 2152 of the dew removal air duct 215 may be in communication with the air return port 214 by penetrating through a sidewall of the air return port 214. That is, the dew removal air duct 215 is in communication with the first chamber 101 via the air return port 214, and there is no need to form another opening in the rear wall 211. The structure designed in this way is quite ingenious, and a perforated structure of the rear wall 211 of the door body 200 is simplified, so that only the air supply port 212 and the air return port 214 need to be directly formed in the rear surface of the rear wall 211 of the door body 200.

In some embodiments, as shown in FIG. 4 and FIG. 6, the air supply port 212 and the air return port 214 are located at a top and a bottom of the rear wall 211, respectively. When the refrigerator runs in the cooling cycle mode, after cold air flows from the air supply port 212 into the second chamber 201, the cold air sinks due to a relatively large density and flows down to sequentially refrigerate regions at all heights of the second chamber 201, and the air flows back to the first chamber 101 via the air return port 214 at the bottom of the second chamber 201 after its temperature rises gradually. In this way, smoother air path circulation is formed, which improves a refrigeration effect of the second chamber 201. When the refrigerator runs in the dew removal mode, cold air enters the dew removal air duct 215 from the top of the dew removal air duct 215, which is more favorable for downward flowing of the cold air, achieves better flowing in the dew removal air duct 215 and accelerates a dew removal process.

As shown in FIG. 5 and FIG. 7, the refrigerator may further include a damper 216, where the damper 216 is installed at the air supply port 212, and is configured to controllably move to a cooling state (as shown in FIG. 5) in which the inlet 2151 is closed and the air supply port 212 is turned on, or move to a dew removal state (as shown in FIG. 7) in which the inlet 2151 is opened and the air supply port 212 is closed. This embodiment makes effective use of the advantage of communication between the inlet 2151 and the air supply port 212, and the air supply port 212 and the inlet 2151 are controlled by one damper 216 at the same time, simplifying air input and output control and achieving an ingenious design.

Specifically, as shown in FIG. 5 and FIG. 7, one end of the damper 216 is rotatably installed at a front edge of the inlet 2151, so that the damper 216 can rotate to the cooling state (as shown in FIG. 5) or the dew removal state (as shown in FIG. 7). In this embodiment of the present invention, complex movement mechanism and control logic are not needed, and the running mode of the refrigerator can be switched by controlling rotation of one damper 216, greatly simplifying the structure and control.

In some embodiments, as shown in FIG. 4 and FIG. 7, the refrigerator further includes a fan 230, where the fan 230 is located at the air supply port 212 to promote the air in the first chamber 101 to flow to the air supply port 212, thus accelerating cooling circulation. Certainly, for a solution in which the inlet 2151 is in communication with the air supply port 212, the fan 230 is also configured to promote the air in the first chamber 101 to flow to the dew removal air duct 215.

The inventors have realized that being closer to the air supply port 212 means more dew being generated at the rear wall 211 of the door body 200; and being closer to the air return port 214 means less dew being generated. Therefore, in this embodiment of the present invention, the arrangement density of the dew removal holes 2154 is specially designed. In a direction from the air supply port 212 to the air return port 214, the arrangement density of the dew removal holes 2154 is gradually reduced to fit with a variation trend of condensation degrees at different locations of the rear wall 211 of the door body 200 and reduce excessive meaningless holes. Holes may be distributed in the overall front surface of the rear wall 211 of the door body 200 so as to realize complete dew removal, or may be distributed in part of the front surface of the rear wall 211. The dew removal holes 2154 may have a percentage of opening of 30% to 80%. The dew removal holes 2154 may be arranged in matrix or in other forms. The dew removal holes 2154 may be circular, oval, square or in other shapes. Preferably, the dew removal holes 2154 are lathy holes whose length direction is parallel to the airflow direction of the dew removal air duct 215. Such structure facilitates destroying integrity of dewdrops and accelerates diffusion and evaporation of the dewdrops.

In conclusion, it should be learned by those skilled in the art that although various exemplary embodiments of the present invention have been illustrated and described in detail herein, many other variations or modifications consistent with the principles of the present invention may be directly determined or derived from the disclosure of the present invention without departing from the spirit and scope of the present invention. Therefore, the scope of the present invention should be construed and considered as covering all these other variations or modifications.

What is claimed is:

1. A refrigerator, comprising:

a glass door;

a refrigerator body, with a front side opened to define a first chamber; and a door body, installed on the refrigerator body to open and close the first chamber, wherein the door body defines a second chamber with an opened front side;

wherein the glass door is installed on the door body to open and close the second chamber;

wherein the glass door comprises:

a glass plate body; and an outer frame, configured to be hinged to the door body of the refrigerator, wherein the outer frame extends along an edge of the glass plate body and is fixedly connected to the edge of the glass plate body; and the outer frame covers part of the edge of the glass plate body; and wherein a rear wall of the door body is provided with an air supply port and an air return port that are both in communication with the first chamber and the second chamber; the rear wall is in a hollow shape, inside which a dew removal air duct in communication with the first chamber is defined; a front surface of the rear wall is backwards provided with a plurality of dew removal holes in communication with the second chamber and the dew removal air duct; and the refrigerator is configured to be:

in a cooling cycle mode in which air in the first chamber enters the second chamber via the air supply port and then returns to the first chamber via the air return port; or in a dew removal mode in which the air in the first chamber enters the dew removal air duct, so that part of an air flow flows to the front surface of the rear wall via the dew removal holes to remove dew formed on the front surface.

2. The refrigerator according to claim 1, wherein the outer frame comprises a vertical frame, and two transverse frames that are bent and extend from two ends of the vertical frame in a length direction, so as to cover a vertical side of the glass plate body and some sections of two transverse sides connected to the vertical side.

3. The refrigerator according to claim 2, wherein a section, that is not covered by the transverse frame, of one transverse side of the glass plate body comprises a handle portion protruding along a vertical direction.

4. The refrigerator according to claim 2, wherein a ratio of a length of each transverse frame to a length of the transverse side of the glass door body is ⅖ to ⅗.

5. The glass deer refrigerator according to claim 1, wherein the outer frame is provided with a clamping slot with an opening toward the edge of the glass plate body to fixedly clamp the edge of the glass plate body.

6. The refrigerator according to claim 1, wherein the glass plate body is made of vacuum glass.

7. The refrigerator according to claim 1, wherein in a direction from the air supply port to the air return port, an arrangement density of the dew removal holes is gradually reduced.

* * * * *